United States Patent [19]

Arnold

[11] 4,103,370

[45] Aug. 1, 1978

[54] ODORLESS WATER CLOSET

[76] Inventor: Douglas L. Arnold, 111 Sorento Dr., Holland, Mich. 49423

[21] Appl. No.: 722,696

[22] Filed: Sep. 13, 1976

[51] Int. Cl.[2] ..... E03D 9/04; A47K 13/00; A47K 3/22

[52] U.S. Cl. ..... 4/213; 4/348; 4/216; 4/217

[58] Field of Search ..... 4/213–217, 4/72, 100, DIG. 3

[56] References Cited

U.S. PATENT DOCUMENTS

| | | | |
|---|---|---|---|
| 1,247,176 | 11/1917 | Swarzman | 4/217 |
| 1,940,163 | 12/1933 | Bystrom | 4/217 |
| 1,997,695 | 4/1935 | Nielsen et al. | 4/213 |
| 2,079,733 | 5/1937 | Cummings | 4/213 |
| 2,151,138 | 3/1939 | Morris | 4/213 |
| 2,171,903 | 9/1939 | Aubin | 4/213 |
| 2,309,885 | 2/1943 | Carman | 4/213 |
| 2,619,655 | 12/1952 | Huff | 4/213 |
| 2,743,462 | 5/1956 | McMillan | 4/213 |
| 2,824,313 | 2/1958 | Bulow | 4/213 |
| 2,985,890 | 5/1961 | Baither | 4/213 |
| 2,988,756 | 6/1961 | Hartley | 4/213 |
| 3,193,846 | 7/1965 | Lafebvre | 4/100 |
| 3,534,415 | 10/1970 | Huffman | 4/213 |
| 3,585,651 | 6/1971 | Cox | 4/213 X |
| 3,790,970 | 2/1974 | Bendersky et al. | 4/213 |
| 3,902,203 | 9/1975 | Poister et al. | 4/213 |
| 3,913,150 | 10/1975 | Poister et al. | 4/217 |
| 3,999,225 | 12/1976 | Ables | 4/217 |

FOREIGN PATENT DOCUMENTS

| | | | |
|---|---|---|---|
| 440,158 | 12/1967 | Switzerland | 4/213 |

*Primary Examiner*—Henry K. Artis
*Attorney, Agent, or Firm*—Glenn B. Morse

[57] ABSTRACT

A water closet has an intake manifold interposed between the seat and the top periphery of the bowl. A suction blower is arranged to draw gases from the manifold, and deliver them to the sewer connection beyond the water trap. The components, including the ventilation connection, are within, or secured to, the bowl and tank structure.

4 Claims, 58 Drawing Figures

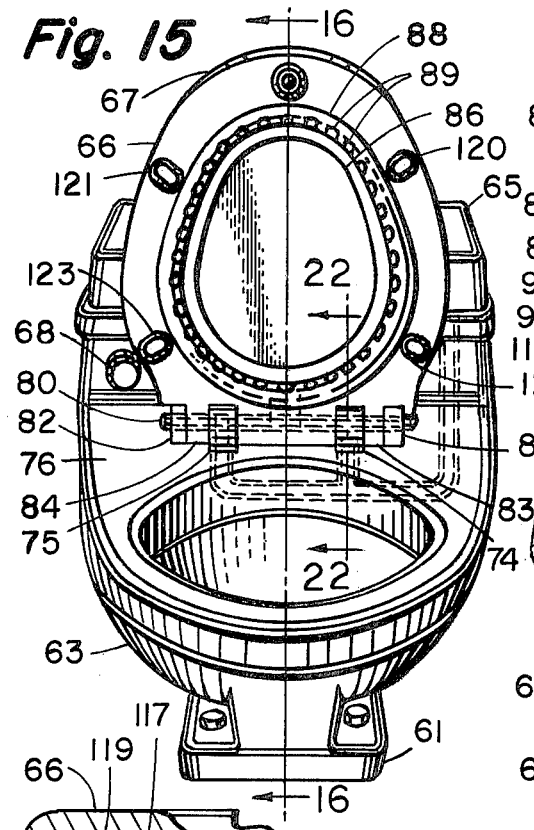
Fig. 15
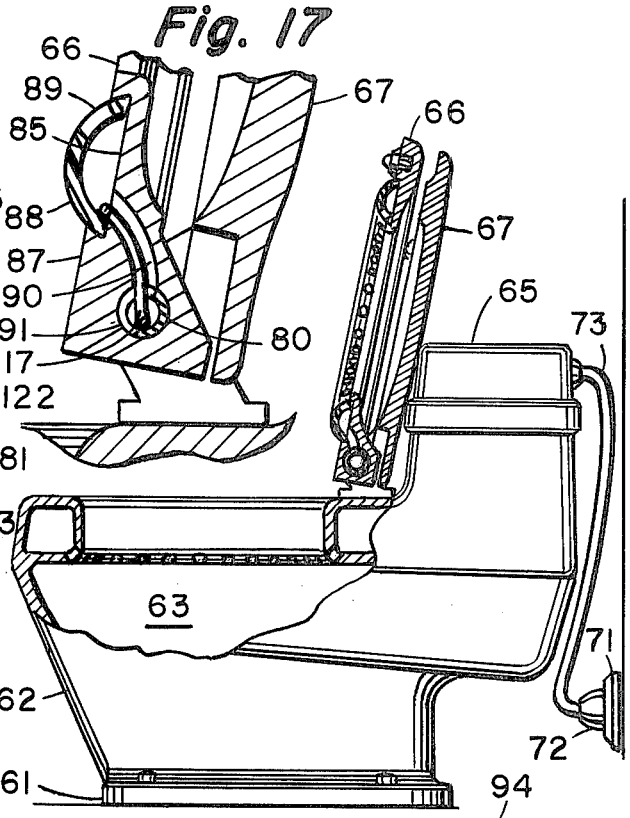
Fig. 17
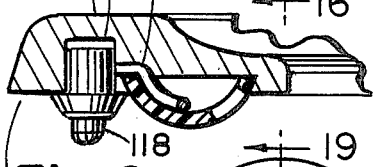
Fig. 21
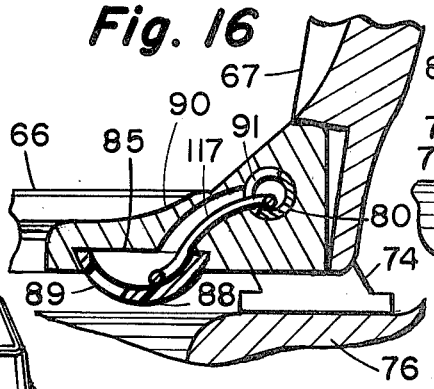
Fig. 16
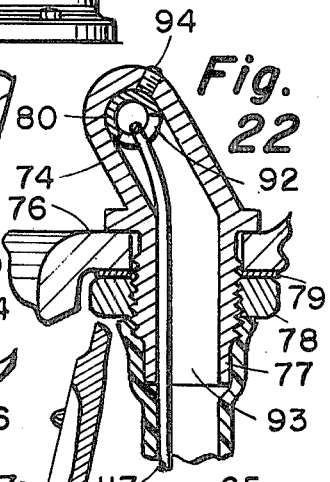
Fig. 22
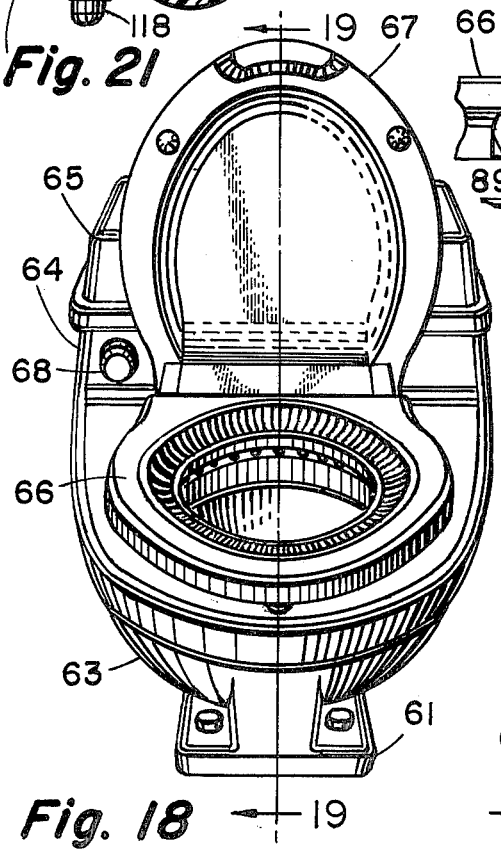
Fig. 18
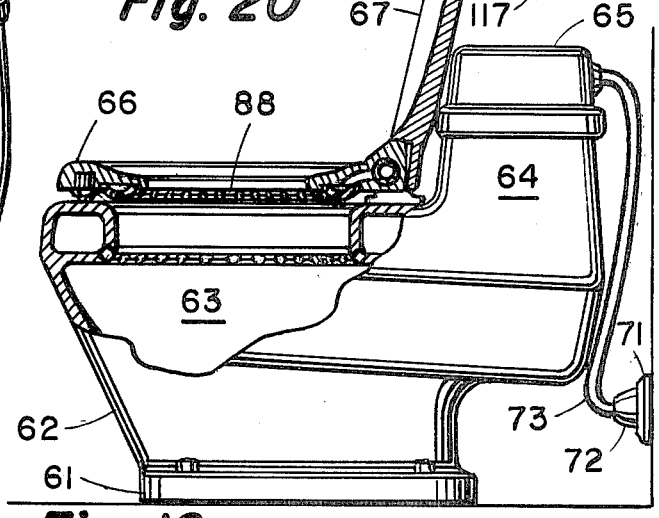
Fig. 19
Fig. 20

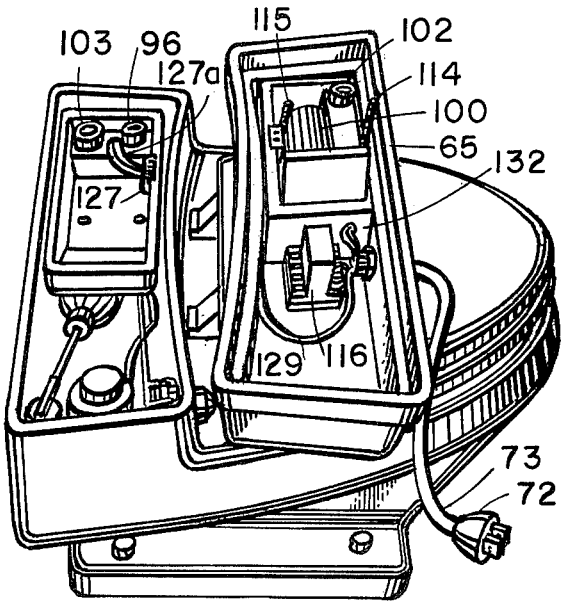
Fig. 23
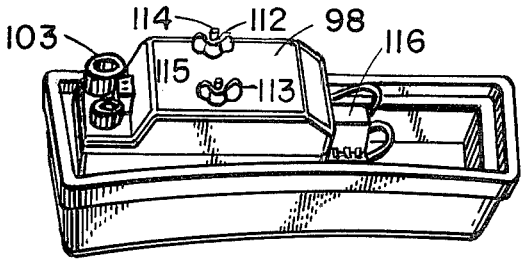
Fig. 24
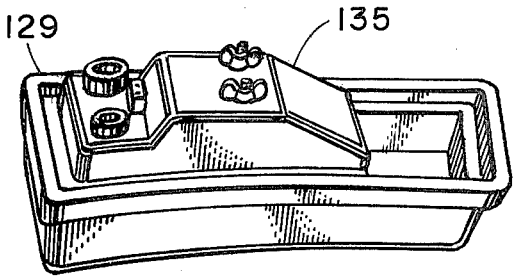
Fig. 27
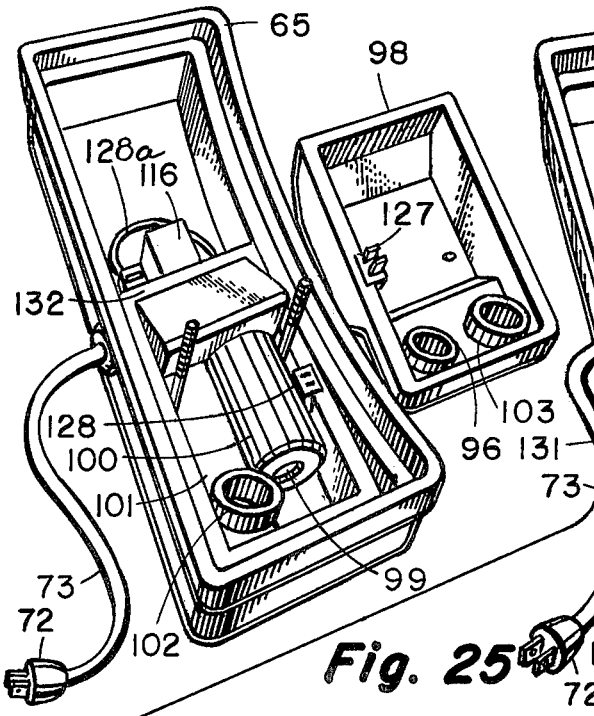
Fig. 25
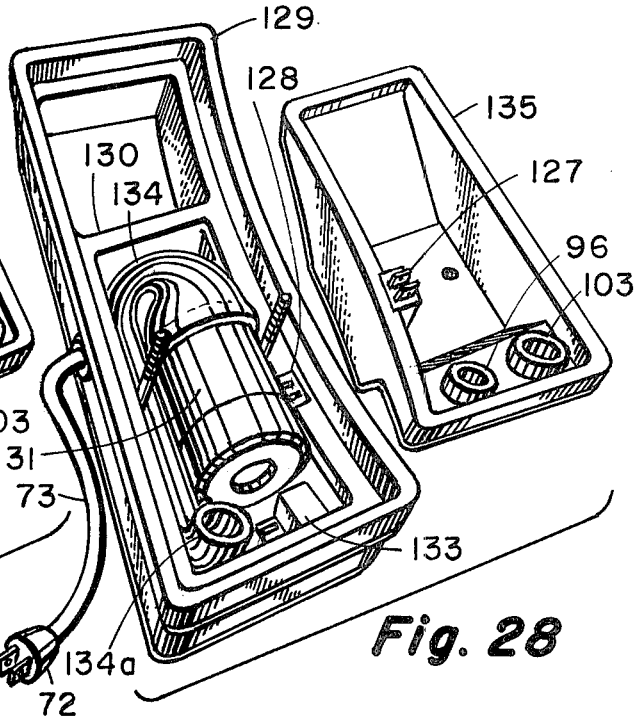
Fig. 28
Fig. 26
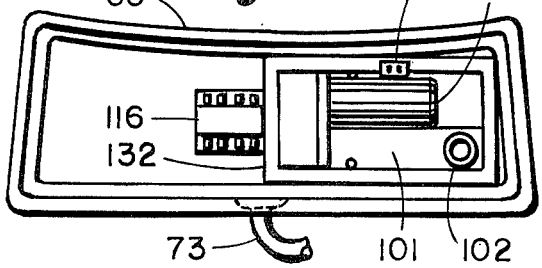
Fig. 29
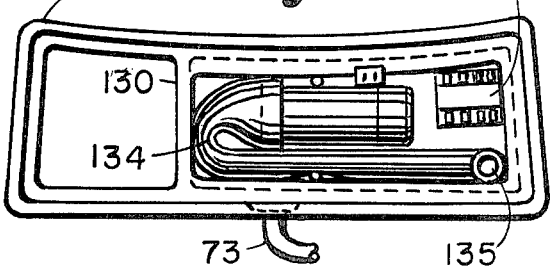

Fig. 47
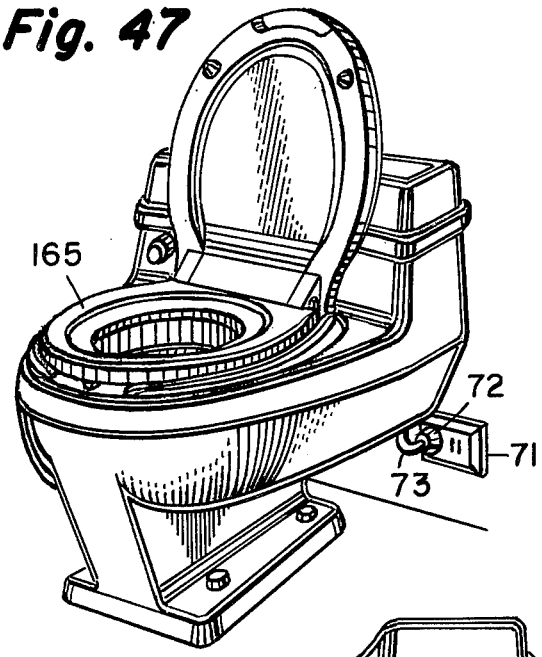
Fig. 48
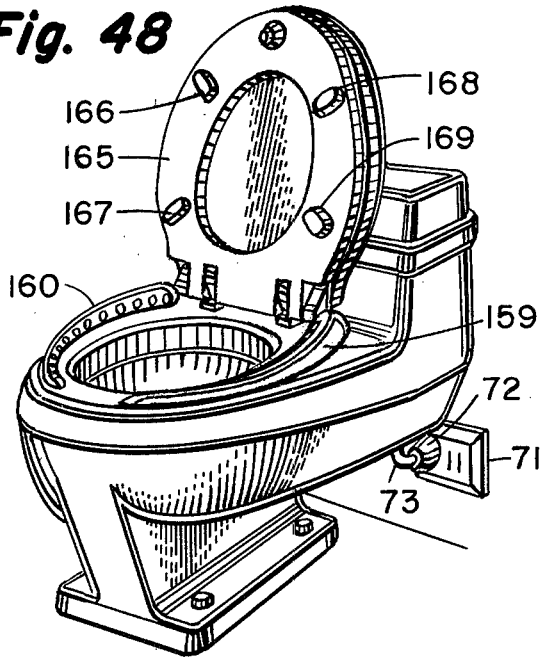
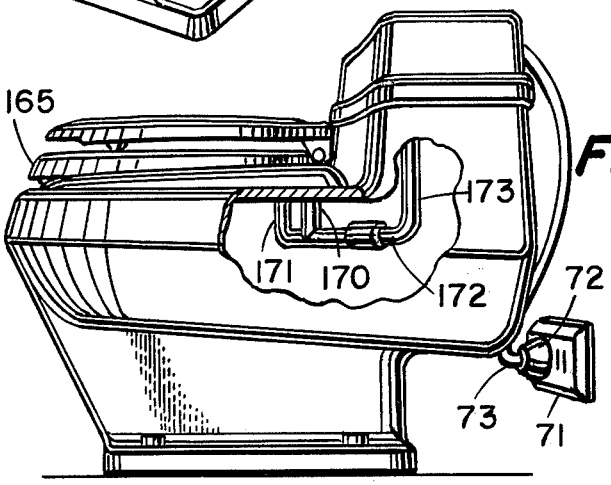
Fig. 49
Fig. 51
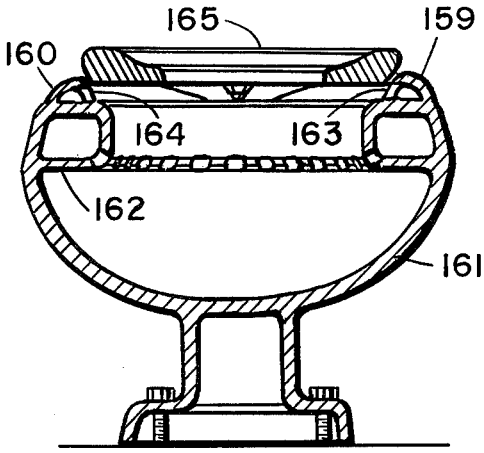
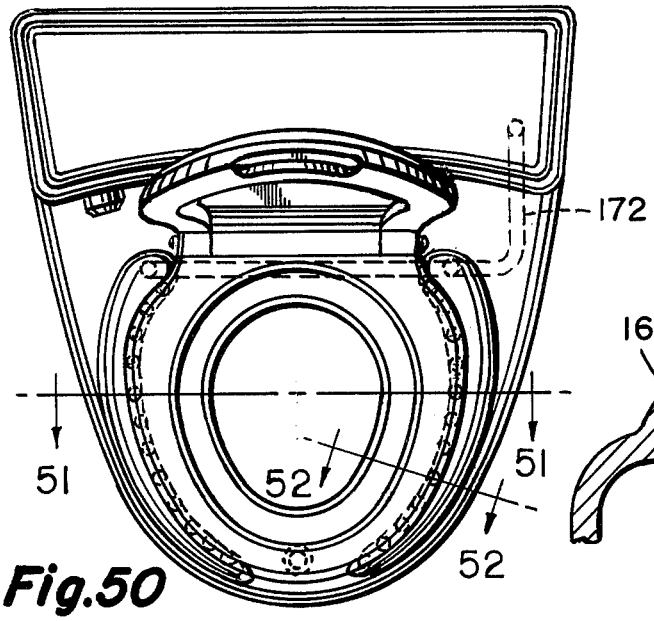
Fig.50
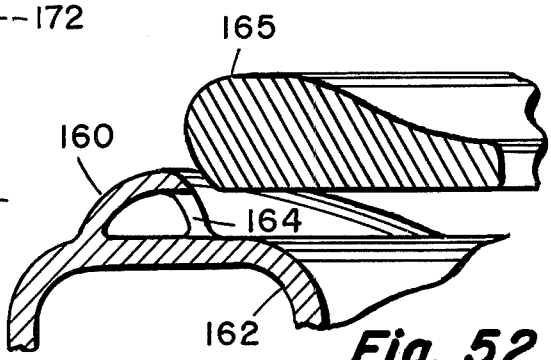
Fig. 52

ODORLESS WATER CLOSET

BACKGROUND OF THE INVENTION

A variety of arrangements have been devised for removing odor-producing gases from the space surrounding a toilet, alternatively referred to as a water closet. One approach has been to apply the intake of a suction blower to the room in which the water closet is installed, with a wall-mounted switch controlling the blower being made conveniently accessible. Another approach has been the provision of a ventilation system incorporated to at least some degree in the structure of the water closet itself. Some form of intake port or manifold is usually provided within the space defined by the bowl and seat, with a suitable blower being adapted with conduits to remove the gaseous accumulations from this space and deliver them to the usual stack vent associated with the sewer system. Present trends in the design of water closets are all tending toward unitary structures of relatively well-proportioned contours, and there is a present need for a ventilation system that can be incorporated in modern integral units with a minimum of alteration of the standard components, and requiring nothing in the way of additional exterior connections to an existing sewer system. A corresponding need is also present for a ventilation system that can have its controls incorporated in the unitary structure without special modification of the walls defining the bathroom.

SUMMARY OF THE INVENTION

The present invention provides a unitary water closet structure that is rendered odorless by incorporating a ventilation system completely within the unit itself. In one form of the invention, an intake manifold is provided around the top periphery of the bowl, together with a conduit communicating between this manifold and a suction blower installed in the tank portion of the water closet. A second form of the invention incorporates the intake manifold in the underside of the seat, with provision being made for what amounts to a flexible conduit system communicating between this manifold and the tank-mounted suction blower. One arrangement for the equivalent of the flexible conduit incorporates a hollow shaft used for pivotally mounting the seat, together with a hollow bracket functioning both to support the seat shaft, and also as a section of the intake conduit. Another arrangement involves the use of interengageable sections of this intake conduit, which are coupled together in at least the "down" position of the seat, and may either be uncoupled in the raised position of the seat, or extended in telescoping relationship. The present invention also includes a control system for the suction blower which incorporates a pressure-sensitive switch responsible for initially energizing the blower, and responsive either to the position of the seat or occupant, or to foot pressure applied by a person standing in front of the unit. The electrical circuit for controlling the blower also preferably incorporates a holding arrangement by which the blower is caused to run for a predetermined period after removal of actuating pressure from the pressure-sensitive switch.

DESCRIPTION OF THE DRAWINGS

FIG. 10 is taken on the plane 10—10 of FIG. 30.

FIG. 15 is a frontal perspective view of the unit in the FIG. 3 position.

FIG. 16 is a side elevation, partially in section, on the plane 16—16 of FIG. 15.

FIG. 17 is an enlarged fragmentary sectional elevation illustrating the structure at the pivotal mounting of the seat, taken on the central plane 16—16 of FIG. 15.

FIG. 18 is a frontal perspective view of the unit in the FIG. 2 position.

FIG. 19 is a view corresponding to FIG. 16, but showing the components in the FIG. 2 position.

FIG. 20 is a view corresponding to FIG. 17, with the unit in the FIG. 2 position.

FIG. 21 is a fragmentary sectional view on an enlarged scale on the central plane 19—19 of FIG. 18, showing the forward portion of the seat structure.

FIG. 22 is an enlarged sectional elevation on the plane 22—22 of FIG. 15.

FIG. 23 is a view similar to FIG. 7, but with the cover to the blower housing removed from the tank cover to expose the interior components. The blower housing cover is in normal position in the tank, but separated from the housing.

FIG. 24 is a rear perspective view of the tank cover in the inverted position, and including the blower housing cover in assembled position.

FIG. 25 is a perspective view on an enlarged scale from the opposite side from that appearing in FIG. 23. The cover is shown removed and inverted from the position appearing in FIG. 24.

FIG. 26 is a top plan view of the sub-assembly including the tank cover and the blower, with the cover to the blower housing removed.

FIG. 27 is a rear perspective of a modified form of sub-assembly which includes the tank cover and the blower mechanism.

FIG. 28 is a view corresponding to FIG. 25, of the form of the invention illustrated in FIG. 27, shown with the cover to the blower housing removed and inverted.

FIG. 29 is a top plan view of the tank cover and blower unit of the FIG. 28 arrangement.

FIG. 47 illustrates a modified form of the invention in front quarter perspective, with the seat cover elevated.

FIG. 48 is similar to FIG. 47, with the seat also in the elevated position.

FIG. 49 is a side elevation of the FIG. 47 unit, partially in section, with both the seat and the cover in the lowered position.

FIG. 50 is a top view of the unit in the FIG. 47 position.

FIG. 51 is a section on the plane 51—51 of FIG. 50.

FIG. 52 is a section on an enlarged scale on the plane 52—52 of FIG. 50.

DESCRIPTION OF THE PREFERRED EMBODIMENTS

Figure 1:
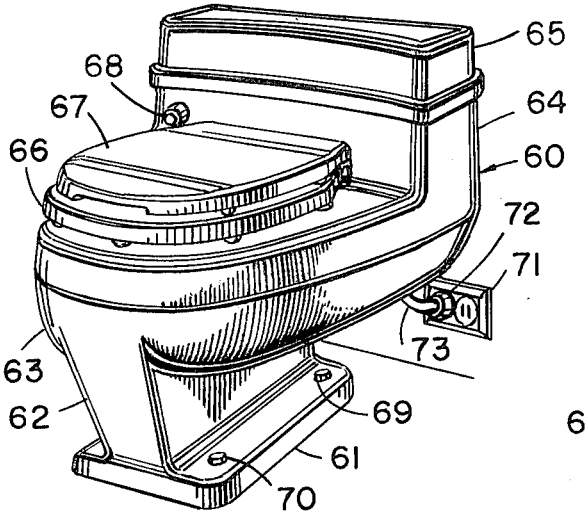
FIG. 1 is a perspective front quarter view of a complete water closet unit incorporating the present invention.
Figure 2:
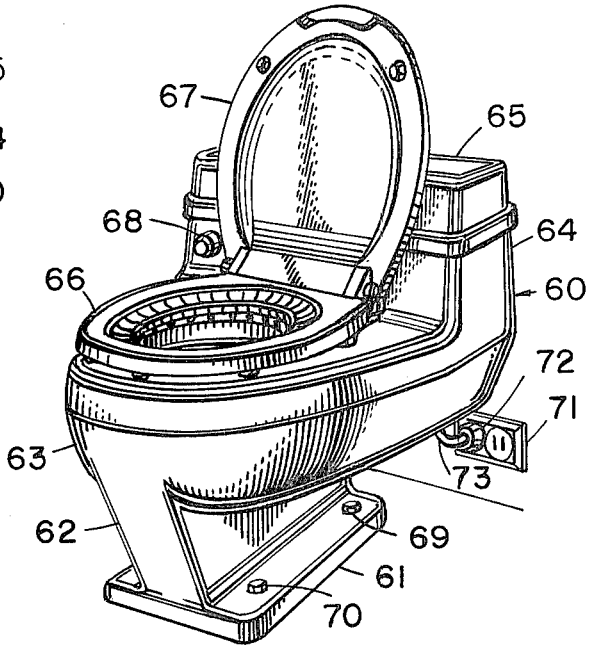
FIG. 2 is a view of the unit illustrated in FIG. 1, with the seat cover elevated to vertical position.
Figure 3:
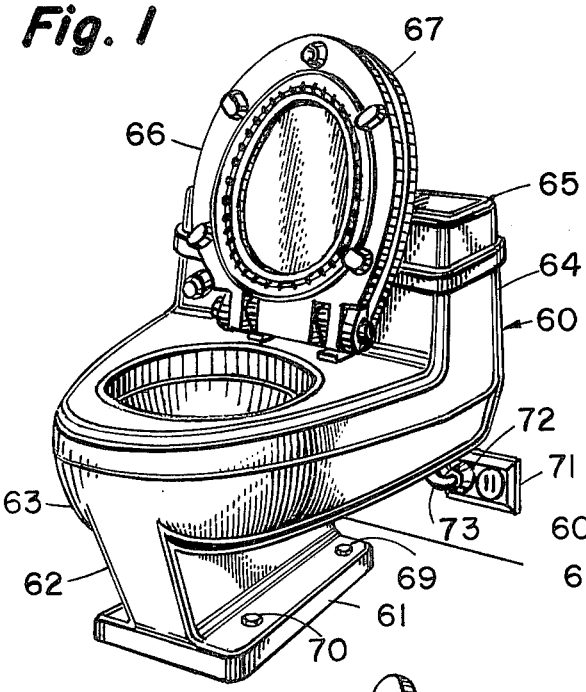
FIG. 3 is a view of the unit illustrated in FIG. 1, with both the cover and the seat elevated to vertical position, exposing the top periphery of the bowl.
Figure 4:
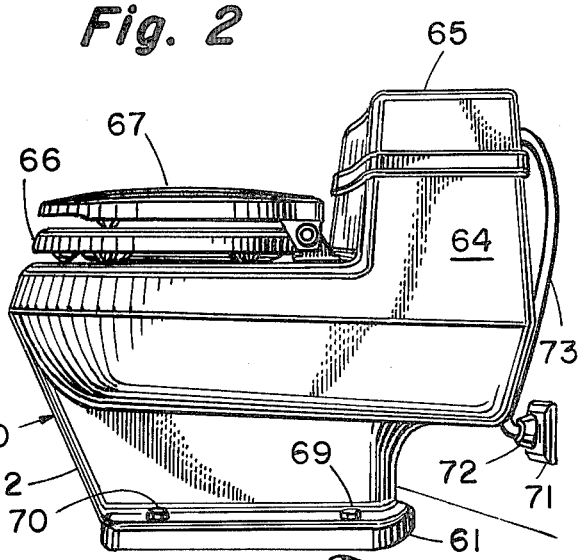
FIG. 4 is a perspective view approaching side elevation of the unit shown in FIG. 1, on a slightly enlarged scale.
Figure 5:
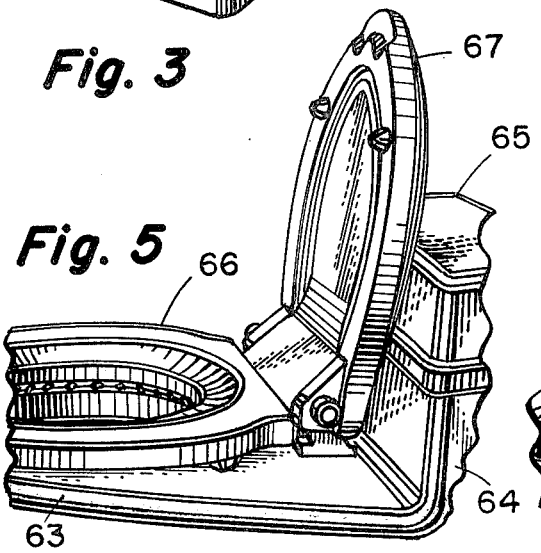
FIG. 5 is a perspective view approaching side elevation of the unit in the FIG. 2 position.
Figure 6:
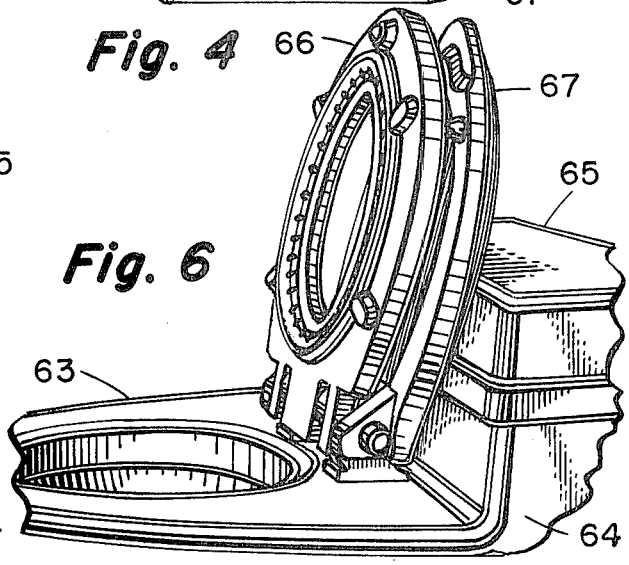
FIG. 6 is a perspective view approaching side elevation of the unit in the FIG. 3 position.
Figure 7:
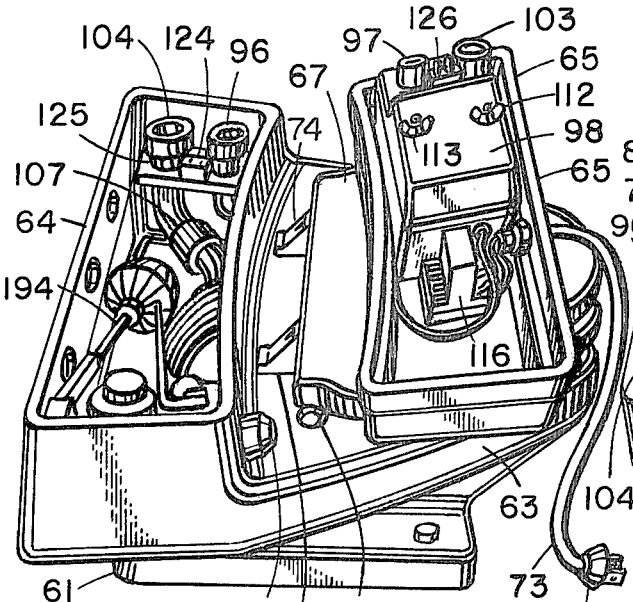
FIG. 7 is a perspective from a side position showing the unit illustrated as in FIG. 1, with the cover of the tank removed and inverted, and placed for convenience on the top of the seat cover.
Figure 8:
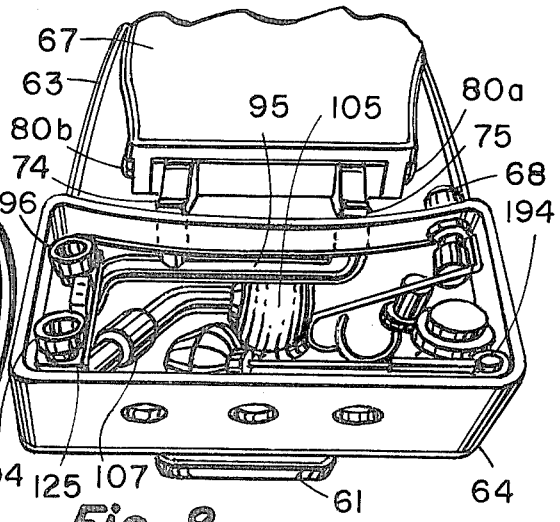
FIG. 8 is a rear view of the assembly with the cover removed.

Referring to FIGS. 1 through 24, the modification illustrated in these views includes an integral ceramic member 60 having a base 61, a central hollow pedestal section 62 forming a downward extension of the bowl section 63, and a tank section 64. A removable tank cover 65 is also normally of ceramic material. A seat 66 and a cover 67 are pivotally mounted usually to the bowl section 63, and a flush control button as indicated at 68 is usually incorporated in the tank section 64. The base 61 is usually secured to the floor on both sides by bolts as shown at 69 and 70 in FIG. 1. A conventional wall-mounted electrical outlet is illustrated at 71 for receiving the plug 72 associated with the cable 73 provided for energizing the ventilating blower. Except for these electrical components, the structure as visible from the exterior FIG. 1 may be considered as conventional.

Referring particularly to FIGS. 15 and 22 (Sheet 3 of the drawings), a pair of hollow pivot brackets 74 and 75 is secured to the top wall 76 of the bowl adjacent the junction of the bowl with the tank. Appropriate holes are provided in the wall for receiving the threaded tubular extensions 77 engaged by the nuts 78, preferably with the washer 79 interposed between the nut 78 and the wall 76. A tubular shaft 80, closed at its ends by the plugs 80*a* and 80*b*, is supported by the brackets 74 and 75, and traverses the lugs 81–82 on the seat cover and the adjacent lugs 83–84 on the seat. The shaft 80 thus forms the fulcrum for the pivotal support of both the seat 66 and the cover 67.

Referring to FIG. 17, the underside of the seat 66 is grooved as shown at 85 around the central opening 86, preferably in a configuration such that the base of the groove is somewhat wider than at the seat surface 87. A manifold member indicated at 88 arcuate in cross-section, preferably with enough resilience to provide a snap-in engagement with the configuration of the groove 85. The member 88 is provided with a series of intake ports indicated at 89. The combination of the groove 85 and the ported member 88 constitutes an intake manifold. Passages 90, preferably at both sides of the back of the seat, communicate between the intake manifold and the tubular shaft 80, which is transversely slotted as shown at 91 to provide communication between the passages 90 and the interior of the shaft. Similar slots as indicated at 92 in FIG. 22 provide communication between the interior of the shaft 80 and the interior 93 of the pivot brackets. The set screw 94 provides assurance that the shaft 80 will not rotate to such a degree as to bring the transverse slots out of registry with the communicating passages.

Figure 9:
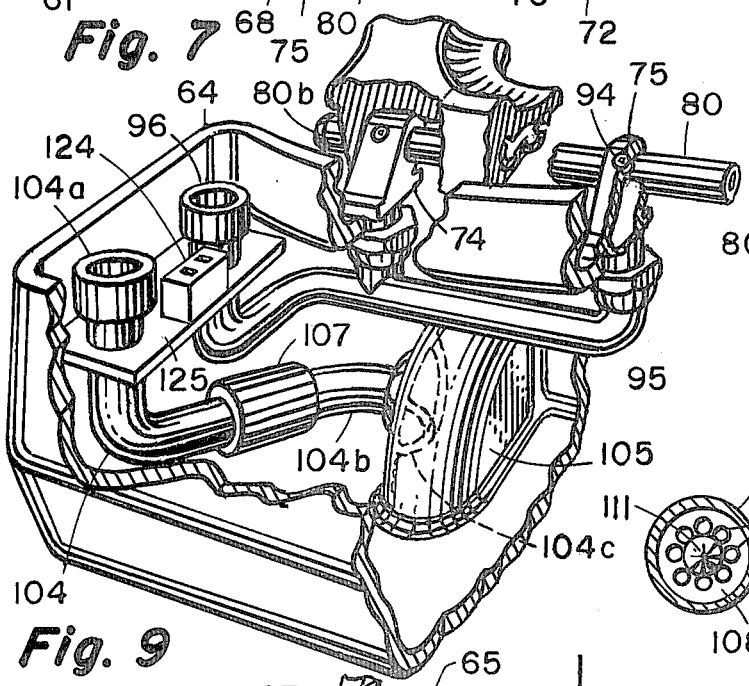
FIG. 9 is a fragmentary perspective sectional view showing the conduit connections within the unit illustrated in FIGS. 1 through 8.

Referring to FIG. 9, the transverse conduit 95 communicates with the tubular extensions 77 of the pivot brackets, and continues on to the exterior section 96 of a coupling which interengages with an inner section 97 associated with the blower system in the housing 98 within the cover 65. The connection 97 leads directly into the space within the housing 98, which communicates with the intake opening 99 of the blower 100. The output of the blower 100 is delivered through the duct 101 to the inner section 102 of a collar secured to the housing to form the interior member 103 of the coupling that interengages with the exterior member 104*a* on the duct 104 illustrated in FIG. 9. The passage extending from the intake manifold of the seat through the passages 90 and the hollow shaft 80, the hollow pivot brackets 74 and 75, and the transverse conduit 95 to the blower housing may be referred to as the intake conduit extending from the manifold to the intake side of the suction blower 100. The exhaust conduit extends from the pressure side of the blower represented by the duct 101 through the coupling 102–104, via the diagonal section 104*b* of the duct 104 to a point of connection with the discharge duct 105 through which the wastes are delivered from the bowl to an appropriate sewer connection. The duct 104*b* communicates with this passage at a point on the opposite side of the trap configuration 106 from the bowl 63. At the point of connection to the duct 105, the duct 104 terminates in the deflector 104*c*, which opens downstream with respect to the water flow in the trap 106 to inhibit any tendency for water to enter the duct 104 (refer to FIG. 10).

Figure 12:
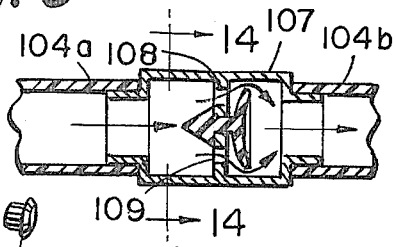
FIG. 12 is an enlarged sectional view of a gas check valve incorporated in the exhaust conduit, shown in the open position.
Figure 13:
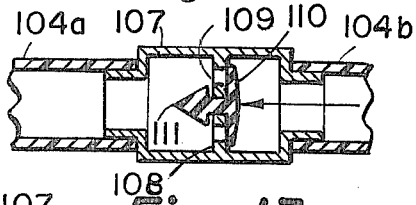
FIG. 13 is a view of the valve illustrated in FIG. 12, but shown in the closed position.
Figure 14:
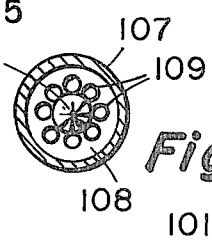
FIG. 14 is a section on the plane 14—14 of FIG. 12.
Figure 10:
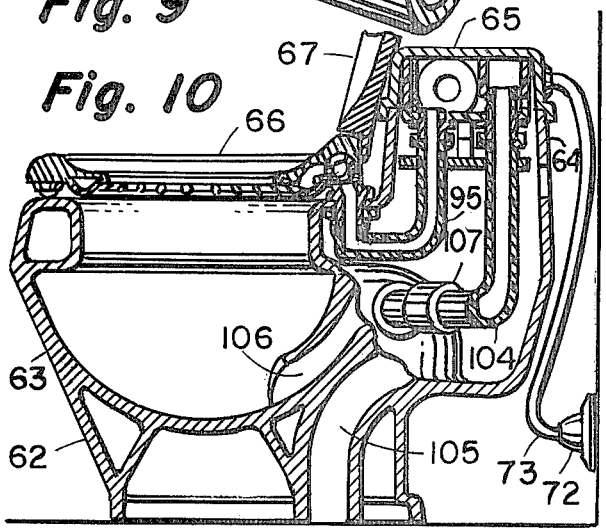
FIG. 10 is a sectional side elevation of the unit shown in the FIG. 2 position.
Figure 11:
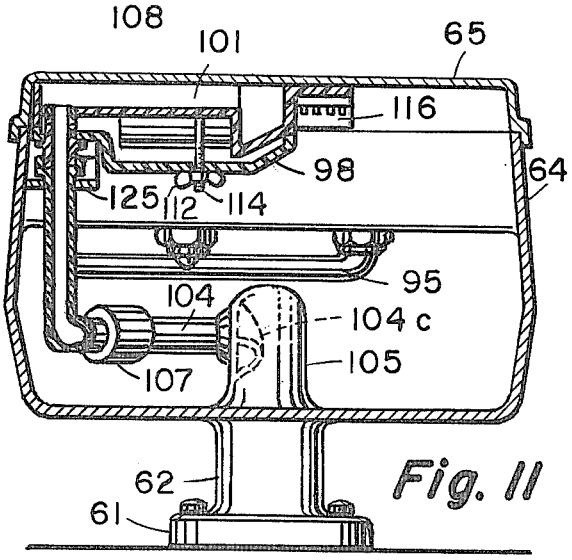
FIG. 11 is a sectional elevation on the transverse plane 11—11 of FIG. 30.
Figure 30:
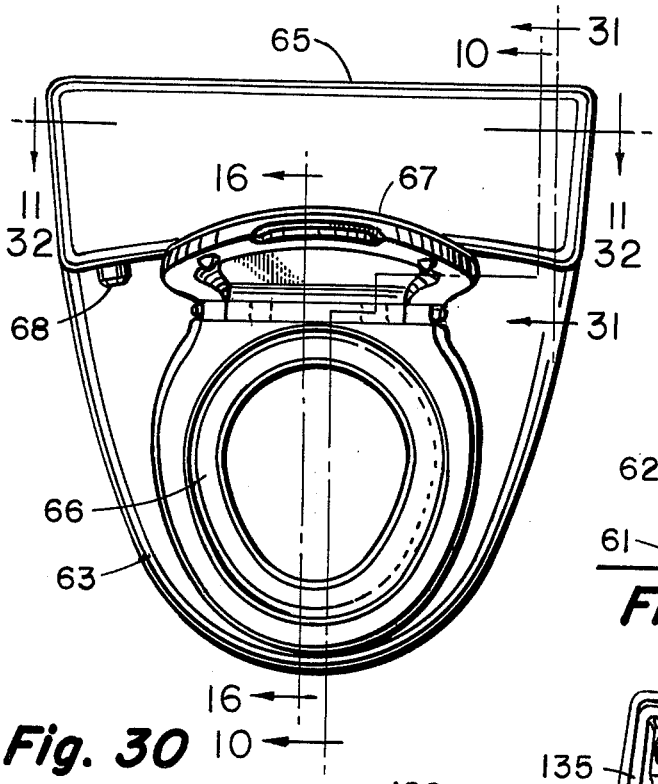
FIG. 30 is a top view of the unit in the FIG. 2 position.
Figure 31:
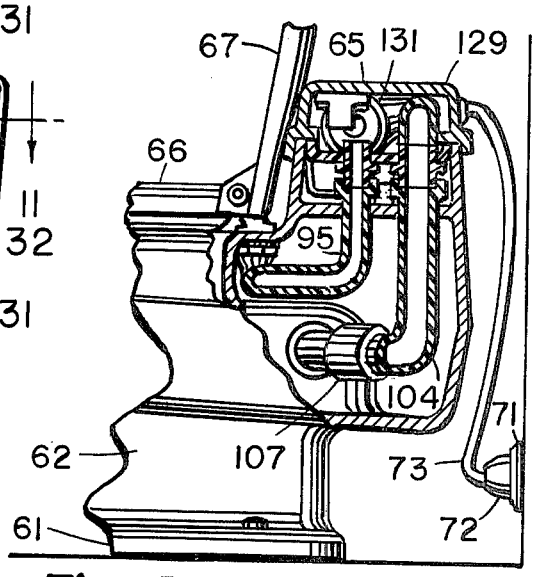
FIG. 31 is a sectional side elevation on the plane 31—31 of FIG. 30.
Figure 33:
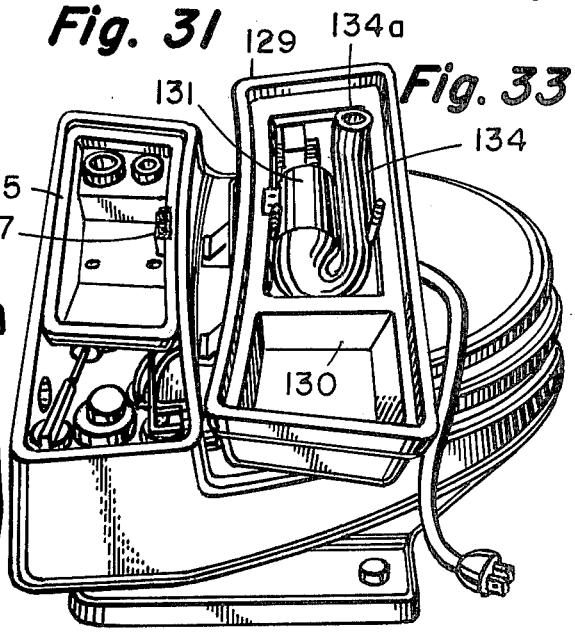
FIG. 33 is a perspective from a side position corresponding to FIG. 23, but showing the FIG. 28 arrangement without the cover for the blower housing.
Figure 32:
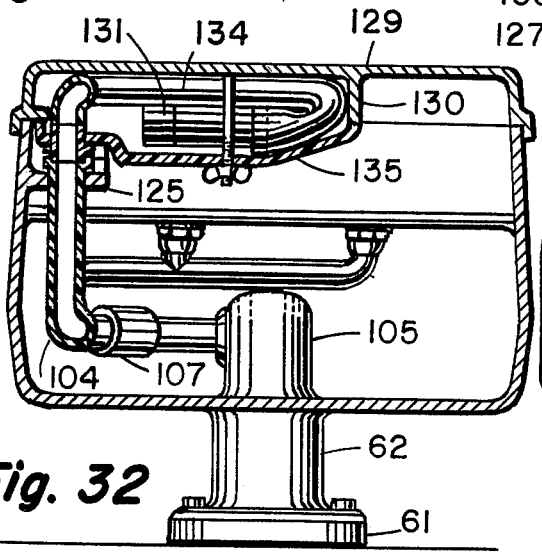
FIG. 32 is a sectional elevation on the plane 32—32 of FIG. 30.
Figure 34:
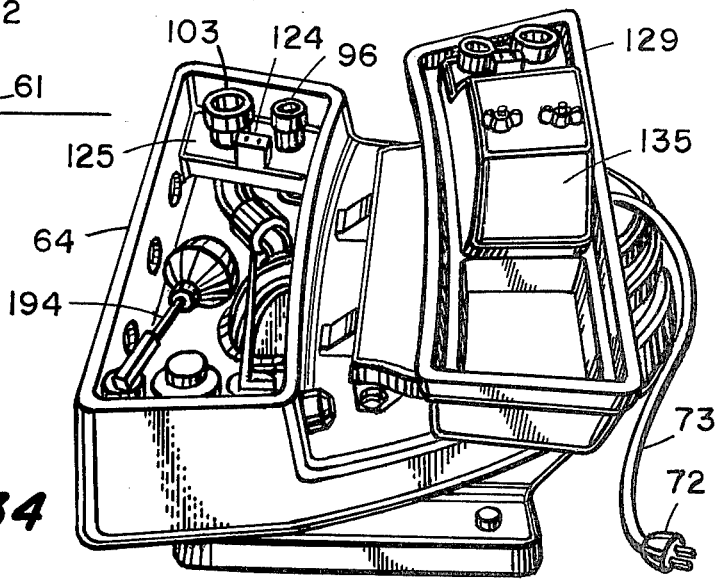
FIG. 34 is a side perspective view similar to FIG. 33, but with the blower housing in assembled position.
Figure 35:
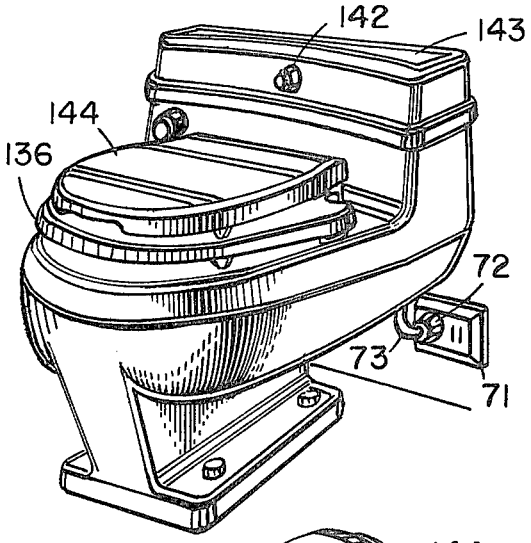
FIG. 35 is a view corresponding to FIG. 1, but illustrating a modified form of the invention with regard to the intake duct communicating between the seat manifold and the ventilation blower.
Figure 36:
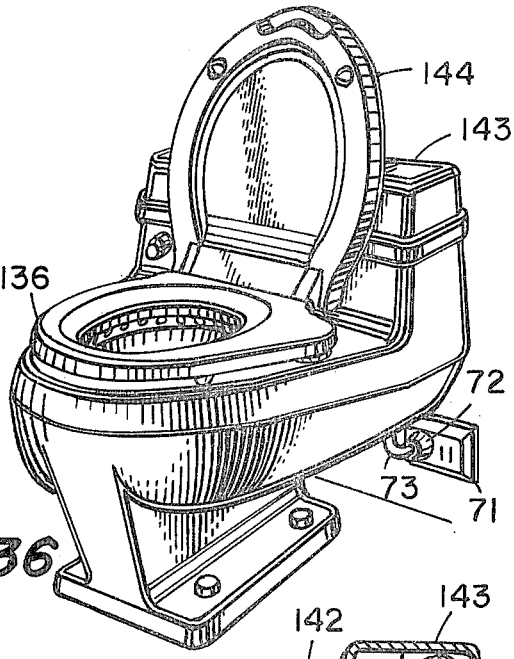
FIG. 36 is a view of the FIG. 35 modification of the invention, with the seat cover elevated.
Figure 37:
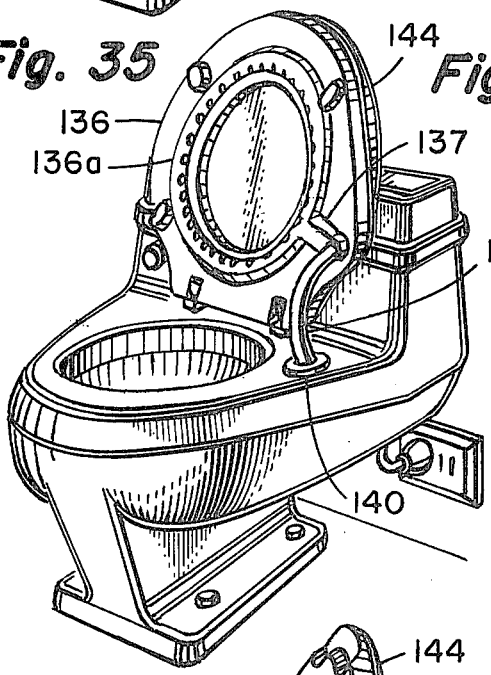
FIG. 37 is a view of the FIG. 35 form of the invention, with both the seat and the cover elevated.

The exhaust duct 104 is provided with the check valve 107 providing for one-way passage of gases in a direction toward the discharge duct 105. The construction of the preferred form of this valve appears in FIGS. 12–14. A transverse wall 108 within the valve 107 is ported as shown at 109 in FIG. 14, and the flexible valve member 110 is adapted to change from the FIG. 13 to the FIG. 12 position under the pressure generated by the blower. Under these conditions, gases are free to move in the direction of the arrows in FIG. 12. Any opposite pressure in the direction of the arrow in FIG. 13 will result in closure of the valve by covering the parts 109, which prevents any passage of gases from the sewer connection 105 back through the blower and the intake conduit where they can emerge into the room via the intake manifold under the seat. The formation of the valve 110 in the configuration shown in FIGS. 12 and 13 is of a rubber-like material that permits the arrowhead-shaped member 111 to be inserted through a central opening in the wall 108 to retain the valve in position with a snap-in relationship. Under normal operation, the exhaust duct will thus function exclusively to deliver gases from the output of the blower to the connection with the discharge passage 105. With the blower cover 98 held in position by the wing nuts 112 and 113 engaging the bolts 114 and 115, respectively, the conduit system extending from the space within the bowl 63 to the sewer connection is complete.

The electrically-operated blower 100 is energized through the double wire 73 extending normally from a wall outlet as shown in FIG. 1. This wire leads to the junction block 116 within the tank cover 65, from which appropriate connections are made to the blower and the the lead 117 that traverses the length of the intake manifold, and continues through the hollow shaft 80 and one of the pivot supports, such as the bracket 74. The lead 117 communicates with the pressure-sensitive switch 118 installed in the recess 119 in the underside of the front of the seat 66. This switch is adjusted such that it responds to contact with the top surface of the bowl, and changes from open to closed conditions under the application of approximately 5 pounds of pressure on the top of the seat. The conventional pads 120–123 provided under the seat have sufficient resilience to accommodate the necessary vertical movement for actuation of the pressure switch 118. The effective closure of this switch initially energizes the blower 100. A conventional holding circuit (not shown) incorporated either directly in the blower or in the block structure 116, will have the effect of continuing the operation of the blower for a predetermined length of time after the release of activating pressure from the switch 118. The blower is thus confined to operation during the period in which the seat is occupied, and for a sufficient period thereafter to assure the complete evacuation of odor-producing gases.

The communication between the pressure-sensitive switch 118 and the blower via the lead 117 proceeds for maximum convenience through several disengageable plug-receptacle units. The first of these is shown at 124 in FIG. 9. The lead wires 117 are connected to the underside of this receptacle, which is mounted on the shelf 125 of the tank structure additionally supporting the coupling 96 and the duct 104. The plug section of this connection is indicated at 126, and is positioned on the underside of the blower housing cover 98. The wiring connections between these units is shown in FIG. 23 at 127*a*. The plug section 127 on the inside of the cover, which interengages with the receptacle unit 128 mounted on the inside of the tank cover within the space occupied by the blower. The wire 128*a* associates the electrical circuit with the receptacle 128. With this arrangement, removal of the tank cover, and also the blower housing cover, are accomplished with the simple disengagement of the plugs from the receptacles, with these sections being appropriately positioned for interengagement by the surrounding structure.

Referring to FIGS. 27, 28 and 29, the modification illustrated in these views is functionally identical to that illustrated in FIGS. 23–26. In the FIGS. 27–29 modification, however, the tank cover 129 is manufactured with a transverse wall 130 defining a chamber for accommodating the blower 131, in contrast to the box-like container 132 appearing in the FIG. 25 arrangement for housing the equipment associated with the blower. The chamber defined by the wall 130 in FIG. 28 also accommodates the terminal block 133, and the formed duct 134 extends from the output of the blower 131 to the connection 134*a* corresponding to the connection 102 of FIG. 25. The blower cover assembly 135 is essentially similar to that of the cover 98. FIGS. 31–34 illustrate the assembled relationships of this form of the invention.

Figure 38:
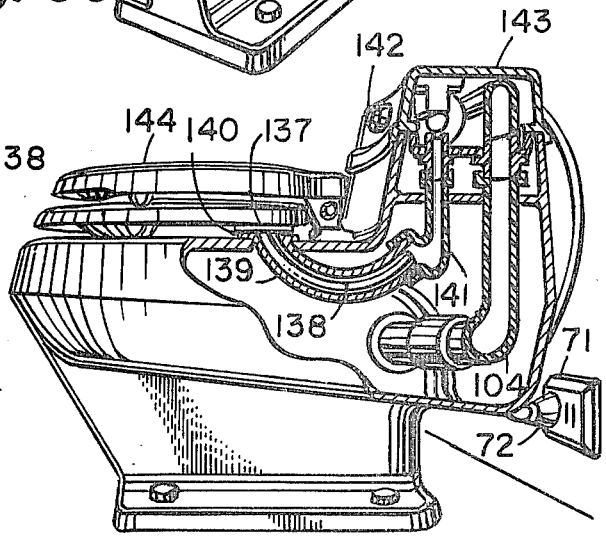
FIG. 38 is a side elevation, partially in section, illustrating the conduit arrangement in the FIG. 37 position.
Figure 39:
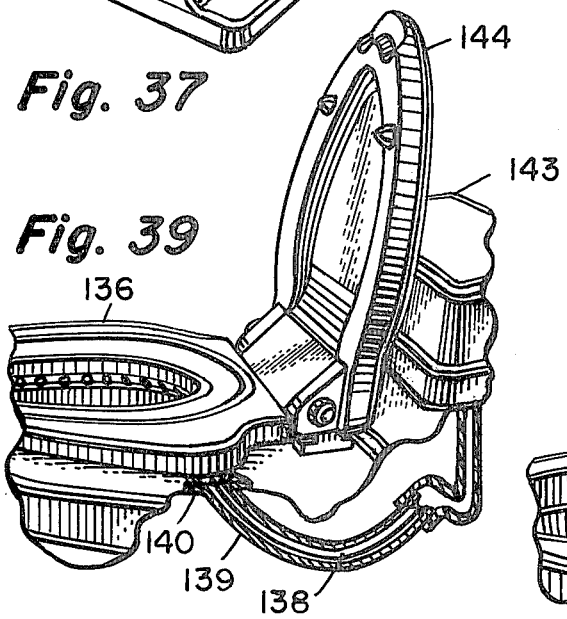
FIG. 39 is a fragmentary sectional side elevation, in perspective, on a slightly enlarged scale over that of FIG. 8, showing the telescoping conduit in retracted condition.
Figure 40:
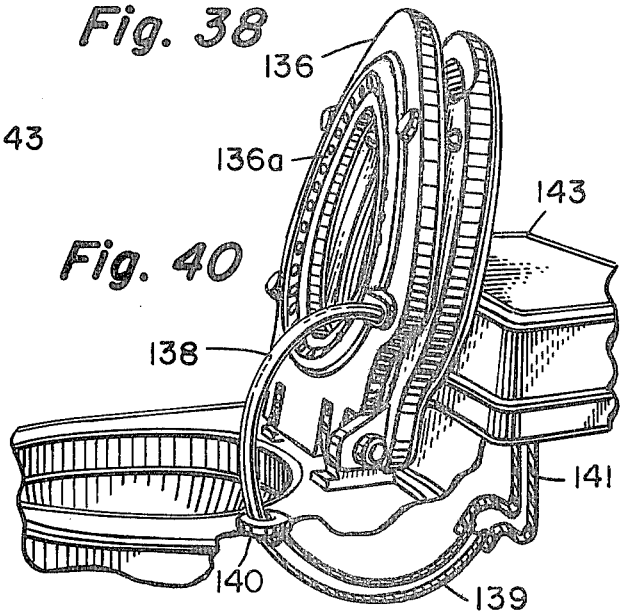
FIG. 40 shows the FIG. 39 structure in the extended condition.
Figure 41:
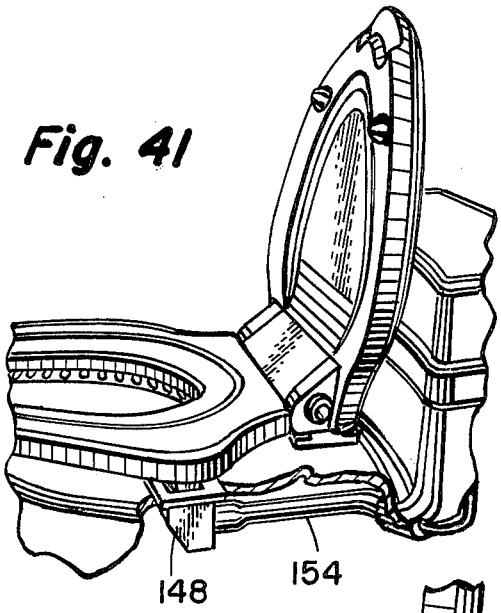
FIG. 41 is a perspective side elevation of a modified form of the invention, showing an alternative form of intake duct communicating between the seat manifold and the suction blower.
Figure 43:
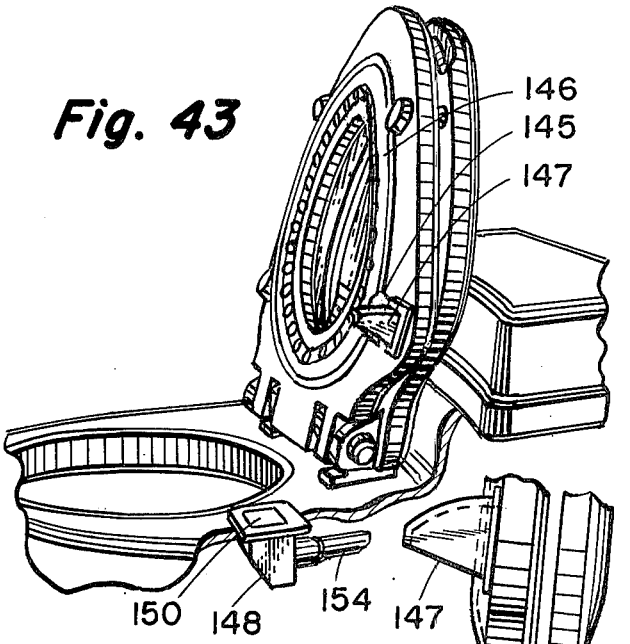
FIG. 43 is a fragmentary perspective sectional elevation showing the FIG. 41 system, with both the seat and the cover elevated.

Referring to FIGS. 35 through 40, the modification of the invention illustrated in these views differs from those previously described primarily in the intake conduit extending from the seat manifold to the bowl-tank unit. The seat 136 has the intake manifold 136*a* provided with the lateral extension 137 functioning as a terminal for the arcuate tube 138, the curvature of which is coaxial with the pivot axis of the seat. A similarly arcuate receptacle 139 has a mounting flange 140 fixed to the top wall of the bowl structure. The arcuate receptacle is engaged by the tubing 141 extending to the coupling within the tank, as previously described. This arrangement replaces the passageway extending within the seat through a hollow pivot shaft and the hollow pivot brackets. Movement of the seat from the horizontal to the elevated position is illustrated in FIGS. 38 and 40, in which a telescoping relationship exists between the tube 138 and the receptacle 139. The remainder of the water closet assembly shown in these views can be identical to that previously described. FIGS. 35–40 do illustrate, however, an optional alternate arrangement for the pressure-sensitive switch. The switch 142 is shown installed at the central portion of the front edge of the tank cover 143. This arrangement eliminates the need for threading the wiring through the intake duct, and functions on the basis that the use of the water closet will normally be limited to the period in which the cover 144 is swung back, and thus bears against the switch 142. This switch can be adjusted to respond solely to the tilt-back pressure of the seat 144, or require additional pressure from the back of the occupant before the switch is deflected to a sufficient degree to energize the blower.

Figure 42:
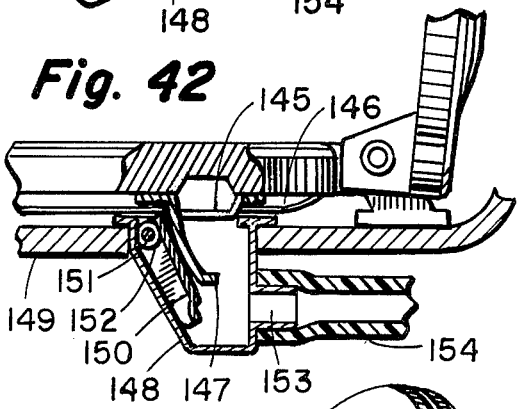
FIG. 42 is an enlarged fragmentary section showing the interengagement of the seat manifold projection with a receptacle constituting part of the intake duct, in the down position of the seat.
Figure 44:
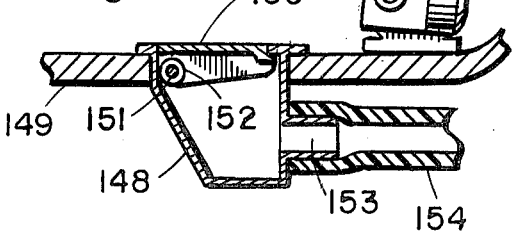
FIG. 44 is an enlarged sectional elevation showing the duct receptacle and the seat projection in the FIG. 43 position.

The modification illustrated in FIGS. 41 through 44 incorporates an alternative arrangement for connecting the intake manifold to the remainder of the intake conduit. The lateral extension 145 of the intake manifold 146 terminates in the normally downwardly-extending projection 147, which registers with the receptacle 148 mounted on the bowl structure 149, as shown in FIG. 42. A trap door 150 is pivotally mounted on the receptacle 148 at the pin 151, and is biased to the closed position shown in FIG. 44 by the spring 152. The receptacle has a connecting collar 153 receiving the flexible tube 154, which associates the assembly with the remainder of the intake duct. The remainder of the water closet assembly is identical to that previously described.

Figure 45:
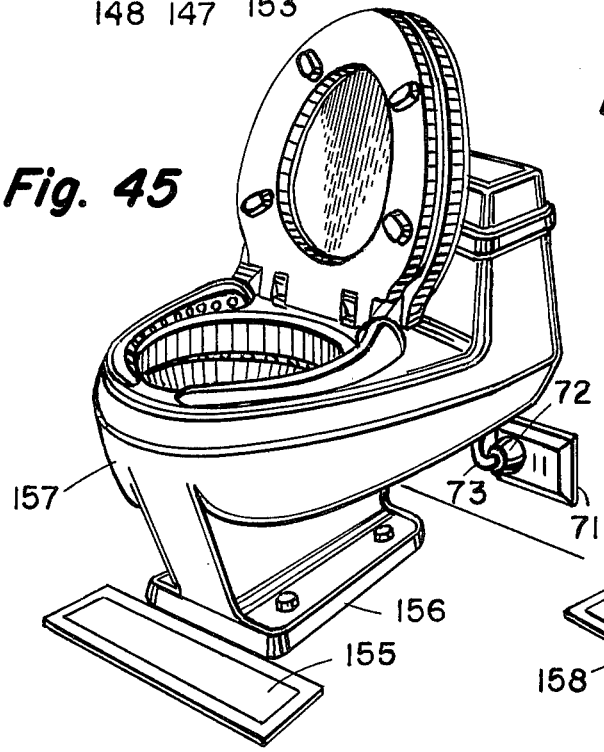
FIG. 45 is a front quarter perspective of a modified form of the invention, with the seat and cover elevated, and incorporating a foot control unit for initially energizing the ventilation blower.
Figure 46:
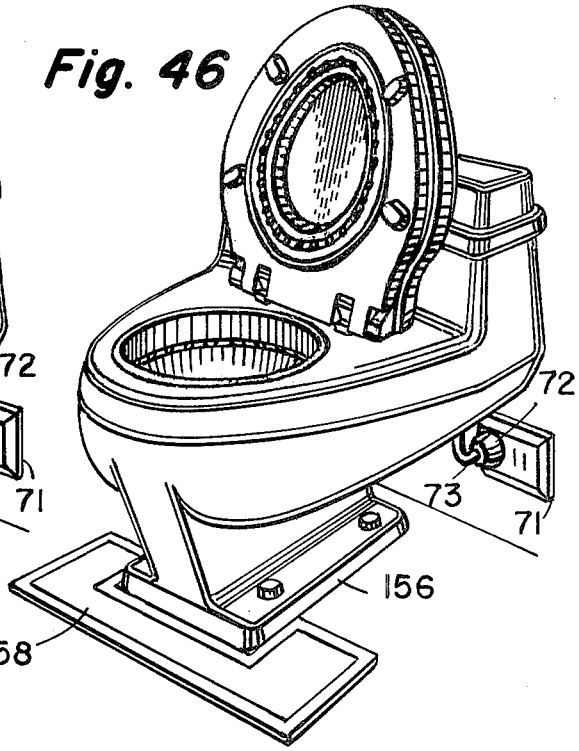
FIG. 46 is similar to FIG. 45, and illustrates a modified form of the foot-actuated control.

FIGS. 45 and 46 illustrate a modified arrangement for the pressure-switch. In FIG. 45, the floor unit 155 incorporates a conventional pressure-sensitive switch (not shown). Wiring of any convenient form may proceed either through the base 156 of the bowl 157 or may be otherwise positioned according to choice. Similarly, FIG. 46 illustrates the floor unit 158, which will accommodate a conventional pressure-sensitive switch to be incorporated in the blower circuit in any convenient manner. The remainder of the water closet assemblies illustrated in FIGS. 45 and 46 can incorporate any of the modifications previously described, or those appearing in FIGS. 47–58.

FIGS. 47 through 52 illustrate a modification of the invention in which the intake manifold is incorporated directly in the top periphery of the bowl structure, rather than being secured to the underside of the seat. The intake manifold sections 159 and 160 are mounted on opposite sides of the bowl structure 161 directly on top of the usual water-drainage manifold 162. Intake ports are arranged around the manifold sections as shown at 163 and 164 in the side areas below the adjacent edges of the seat 165. The seat may be arranged to bear directly on the intake manifold sections 159 and 160, or may be positioned in the usual manner by the pads 166–169. The rear portions of the intake duct sections 159 and 160 terminate in downward conduits 170 and 171 terminating in the diagonal collector conduit 172 and the riser 173, which leads to the blower assembly. The remainder of the assembly shown in FIGS. 47–51 can incorporate the structure previously described.

Figure 53:
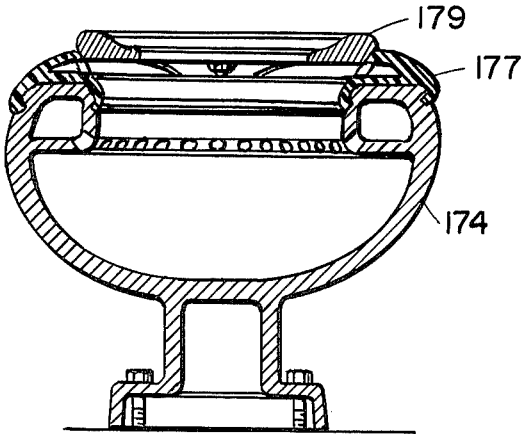
FIG. 53 is a sectional elevation on a plane similar to 51—51 of FIG. 50, but illustrating a modified form of the invention with regard to the intake manifold as a separate attachable component.
Figure 54:
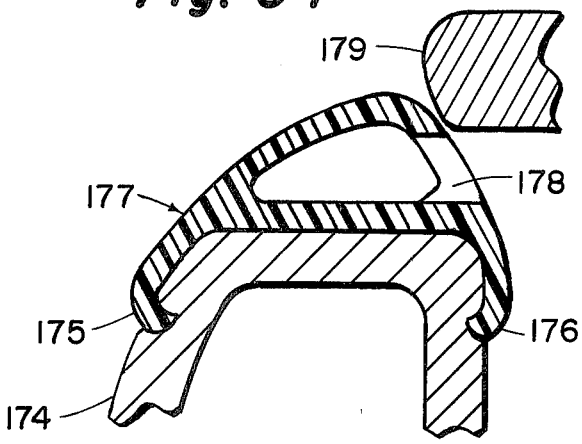
FIG. 54 is a fragmentary sectional elevation, on an enlarged scale over that of FIG. 53, illustrating the interrelationship between the attachable manifold unit and the top periphery of the bowl.

FIGS. 53 and 54 show an alternative arrangement to that appearing in FIG. 52. The top periphery of the bowl 174 is grooved along its opposite edges to receive the inwardly-turned flanges 175 and 176 of the molded manifold unit 177. This is preferably a snap-in relationship. Ports as shown at 178 are distributed around the manifold unit at a point just below the plane of the underside of the seat 179. Connections of this manifold unit to the remainder of the intake duct system can be of the type shown in FIG. 49.

Figure 55:
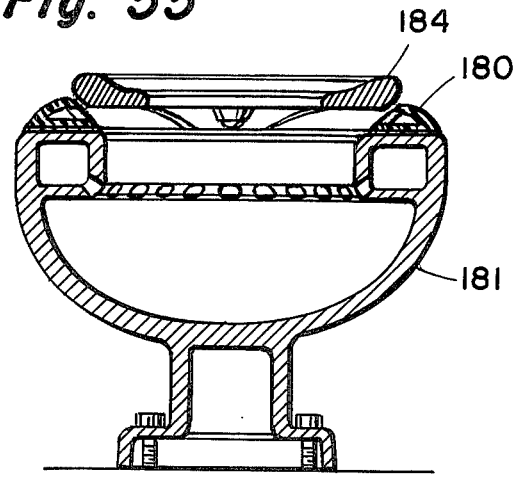
FIG. 55 is a section similar to FIG. 53, but showing an alternative arrangement for attaching the intake manifold to the top periphery of the bowl.
Figure 56:
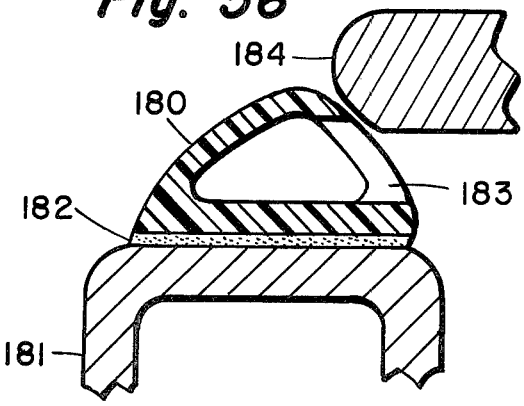
FIG. 56 is an enlarged fragmentary section at the junction of the manifold and the bowl periphery as shown in FIG. 55.
Figure 57:
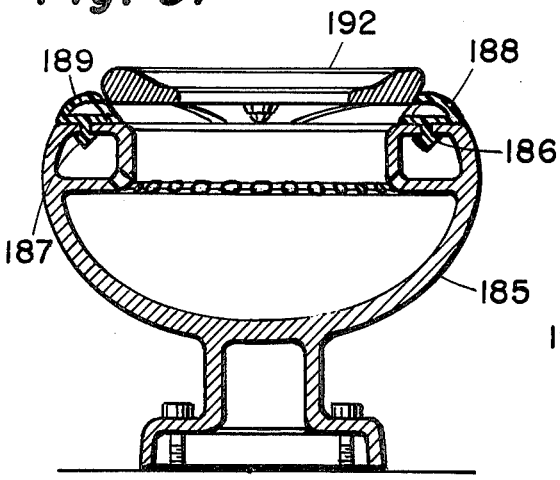
FIG. 57 illustrates a further modification of the invention with regard to an attachable intake manifold secured in a different manner to a top periphery of the bowl.
Figure 58:
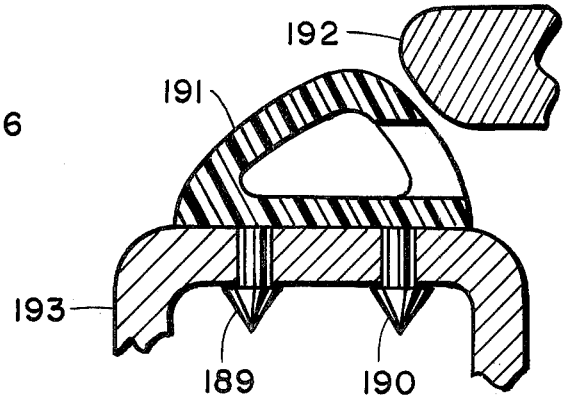
FIG. 58 is an enlarged fragmentary section showing the interengagement of the manifold and the top periphery of the bowl, as illustrated in FIG. 57.

FIGS. 55 and 56 show a further alternate possibility, in which the molded manifold unit 180 is secured to the top surface of the periphery of the bowl 181 by a layer of adhesive, as indicated at 182. Ports as shown at 183 are provided in the manifold unit as previously described. In FIGS. 57 and 58, the top surface of the periphery of the bowl 185 is provided with a series of holes registering with projections as shown at 186 and 187 (in FIG. 57) on the manifold sections 188 and 189, respectively. The projections are preferably integral with the manifold sections, and of a material such that the pointed end configurations of the projections can be forced through the narrower holes in the top surface of the bowl. Connections of these manifold sections to the remainder of the intake duct system are as shown in FIG. 49. FIG. 58 is similar to FIG. 57, except for the provision of the double projections 189 and 190 giving somewhat greater retention against side forces. The cross-section of the manifold 191 is the same as that of the section 189, as well as its placement with respect to the seat 192. The bowl 193 is similar in other respects to the bowls previously described.

In all of the modifications of the invention, the internal flushing mechanism indicated generally at 194 is conventional, and requires little or no modifications. Certain particular flushing mechanisms may present problems in spatial interference, but these are usually easily accommodated by minor revisions of either the mechanism or the ducting associated with the present invention.

I claim:

1. An odorless water closet including a bowl, a tank having a cover, flushing conduit means communicating between said bowl and said tank, discharge conduit means including a trap, and communicating with said bowl and adapted for connection to a sewage pipe, water-control means adapted to control the supply of water to said tank, flush valve means adapted to discharge the contents of said tank to said bowl, and seat means pivotally mounted on said bowl for movement between a horizontal position over said bowl and an elevated substantially vertical position normally at the rear of said bowl and adjacent said tank, and also including ventilating means adapted to exhaust gases from within said bowl, wherein the improvement comprises:

an intake manifold disposed and mounted on the underside of said seat and adjacent the periphery of said bowl, and an intake conduit extending from said intake manifold; and an exhaust conduit communicating between said intake conduit and said discharge conduit within said tank on the opposite side of said trap from said bowl, said exhaust conduit including blower means adapted to induce flow in said exhaust conduit toward said discharge conduit, and also including one-way valve means, said exhaust conduit also including a tubular member forming a pivotal mounting for said seat, and further including hollow bracket means mounted on said bowl and supporting said tubular member, said bracket means having a tubular vertical portion traversing a portion of said bowl.

2. An odorless water closet including a bowl, a tank having a cover, flushing conduit means communicating between said bowl and said tank, discharge conduit means including a trap, and communicating with said bowl and adapted for connection to a sewage pipe, water-control means adapted to control the supply of water to said tank, flush valve means adapted to discharge the contents of said tank to said bowl, and seat means pivotally mounted on said bowl for movement between a horizontal position over said bowl and an elevated substantially vertical position normally at the rear of said bowl and adjacent said tank, and also including ventilating means adapted to exhaust gases from within said bowl, wherein the improvement comprises:

an intake manifold disposed mounted on the underside of said seat and adjacent the periphery of said bowl, and an intake conduit extending from said intake manifold; and an exhaust conduit communicating between said intake conduit and said discharge conduit within said tank on the opposite side of said trap from said bowl, said exhaust conduit including blower means adapted to induce flow in said exhaust conduit toward said discharge conduit, and also including one-way valve means, said exhaust conduit including a downwardly-extending tubular extension on said intake manifold, and a receptacle secured to said bowl and adapted to receive said tubular extension in all positions of said seat, said extension and receptacle being arcuate and concentric with the axis of pivotal mounting of said seat.

3. An odorless water closet including a bowl, a tank having a removable cover, flushing conduit means communicating between said bowl and said tank, discharge conduit means including a trap, and communicating with said bowl and adapted for connection to a sewage pipe, water-control means adapted to control the supply of water to said tank, flush valve means adapted to discharge the contents of said tank to said bowl, and seat means pivotally mounted on said bowl for movement between a horizontal position over said bowl and an elevated substantially vertical position normally at the rear of said bowl and adjacent said tank, and also including ventilating means adapted to exhaust gases from within said bowl, wherein the improvement comprises:

an intake manifold disposed mounted on the underside of said seat and adjacent the periphery of said bowl, and an intake conduit extending from said intake manifold; and an exhaust conduit communicating between said intake conduit and said discharge conduit within said tank on the opposite side of said trap from said bowl, said exhaust conduit including blower means adapted to induce flow in said exhaust conduit toward said discharge conduit, and also including one-way valve means, said ventilating means including a blower mounted on the inside of said cover, and including disengagable coupling sections in said intake and exhaust conduits, said conduits communicating with said blower.

4. An odorless water closet as defined in claim 3, additionally including a disengageable electrical connector means incorporated in a circuit operative to energize said blower means, said connector means having plug and receptacle portions, one mounted on said cover, and the other fixed with respect to said tank.

* * * * *